US009989249B2

(12) United States Patent
Bell

(10) Patent No.: US 9,989,249 B2
(45) Date of Patent: Jun. 5, 2018

(54) INWARD FIRING MULTIPLE ZONED GAS BURNER

(71) Applicant: BURNERTECH COMBUSTION ENGINEERS, LTD., Bolton (GB)

(72) Inventor: David Thomas Bell, Bolton (GB)

(73) Assignee: Burnertech Combustion Engineers, Ltd., Bolton (GB)

( * ) Notice: Subject to any disclaimer, the term of this patent is extended or adjusted under 35 U.S.C. 154(b) by 155 days.

(21) Appl. No.: 14/905,503

(22) PCT Filed: Mar. 27, 2014

(86) PCT No.: PCT/GB2014/000117
§ 371 (c)(1),
(2) Date: Jan. 15, 2016

(87) PCT Pub. No.: WO2014/167270
PCT Pub. Date: Oct. 16, 2014

(65) Prior Publication Data

US 2016/0169508 A1 Jun. 16, 2016

(30) Foreign Application Priority Data

Apr. 10, 2013 (GB) ..... 1306511.5

(51) Int. Cl.
*F23D 14/06* (2006.01)
*F23C 3/00* (2006.01)
(Continued)

(52) U.S. Cl.
CPC ..... *F23D 14/06* (2013.01); *F23C 3/002* (2013.01); *F23D 14/14* (2013.01); *F23D 14/16* (2013.01)

(58) Field of Classification Search
CPC ..... F23D 14/06; F23D 14/14; F23D 14/16; F23D 14/58; F23D 14/84; F23D 14/08;
(Continued)

(56) References Cited

U.S. PATENT DOCUMENTS 2,184,653 A * 12/1939 Sherrick ..... F23D 14/00 431/198
2,967,224 A * 1/1961 Irwin ..... F02C 7/264 219/270
(Continued)

FOREIGN PATENT DOCUMENTS

JP 2004-44845 A1 2/2004

OTHER PUBLICATIONS

"JP_2004044845A_M—Machine Translation.pdf", machine translation, JPO.org, Jun. 22, 2017.*
(Continued)

*Primary Examiner* — Gregory Huson
*Assistant Examiner* — Daniel E Namay
(74) *Attorney, Agent, or Firm* — TannerIP PLLC; Daniel A. Tanner, III; James E. Golladay, II

(57) ABSTRACT

An inward firing multi burner system is provided that can modulate its output and have two or more independent gas/air supplies firing via multiple burners in the same burner cylinder or burner head compartment. Independent control of one or more of gas/air supplies to the multiple burners yields a comparatively large modulation range.

8 Claims, 1 Drawing Sheet

Figure 1:
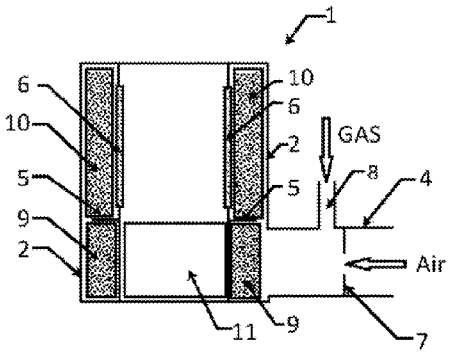

(51) Int. Cl.

| | |
|---|---|
| ***F23D 14/14*** | (2006.01) |
| ***F23D 14/16*** | (2006.01) |
| *F23D 14/08* | (2006.01) |
| *F23D 14/58* | (2006.01) |

(58) Field of Classification Search
CPC ..... F23D 2203/1012; F23D 2205/00; F23D 23/00; F23D 2204/00; F23D 2209/20; F23C 3/002; F23C 3/00
USPC ..... 431/355, 328, 172, 285
See application file for complete search history.

(56) References Cited

U.S. PATENT DOCUMENTS

| | | | | | |
|---|---|---|---|---|---|
| 3,384,442 | A * | 5/1968 | Stewart | F23C 3/00 | 431/157 |
| 5,240,411 | A * | 8/1993 | Abalos | F23D 14/145 | 126/92 AC |
| 5,458,484 | A * | 10/1995 | Ripka | F23D 14/58 | 126/109 |
| 5,503,685 | A * | 4/1996 | Goldstein | G02B 6/02 | 136/253 |
| 5,749,720 | A * | 5/1998 | Fukuda | F23D 14/16 | 126/91 A |
| 5,921,770 | A * | 7/1999 | Sattelmayer | F23C 7/002 | 431/285 |
| 6,030,206 | A * | 2/2000 | Shizukuisha | F23C 5/02 | 431/328 |
| 6,065,962 | A * | 5/2000 | Shizukuisha | F23D 14/145 | 431/328 |
| 7,985,067 | B2 * | 7/2011 | Hody | F23C 3/002 | 126/92 AC |
| 2005/0048430 | A1 * | 3/2005 | Steiner | F23D 11/007 | 431/278 |
| 2008/0021393 | A1 * | 1/2008 | Gill | A61F 7/0085 | 604/113 |
| 2008/0121117 | A1 * | 5/2008 | Best | A47J 37/0635 | 99/339 |
| 2008/0131746 | A1 | 6/2008 | Hody | | |
| 2010/0035194 | A1 * | 2/2010 | Assmann | B22D 41/015 | 431/8 |

OTHER PUBLICATIONS

International Search Report for PCT/GB2014/000117 dated Jul. 2, 2014.

* cited by examiner

INWARD FIRING MULTIPLE ZONED GAS BURNER

This invention relates to a gas burner having one chamber yet two or more independent gas and air feeds and burner surfaces the primary being an inward firing burner and the secondary being a flat, domed, cylindrical, conical, round or inward firing.

To increase efficiency and reduce emissions on gas fired appliances it is becoming common practice to use a system where the gas and air is premixed before being ignited and burned on a burner media of differing materials. However, the use of these systems can lead to a number of difficulties as these systems use a modulating fan or damper system to increase or decrease the capacity of the burner, the air is then passed over or through a venturi or form of orifice which then by means of positive or negative pressure controls the amount of gas that is then mixed with the air. This then gives a relatively stable gas air mix and ratio. The problem arises that the air fan has a maximum and minimum speed and performance even if used with a fixed fan speed and modulating damper, also the gas valve has a minimum positive or negative pressure required to operate which is normally well above the minimum speed or performance of the air fan. Along with this the burner media material will only be stable up the a certain maximum capacity before the flame lifts from the surface and becomes unstable and a minimum capacity before the material becomes hot and the flame speed so low that the flame leaves the surface of the burner media and ignites inside the burner causing an explosion.

To overcome these problems the present invention has two or more independent burners firing inside the same burner chamber, the primary burner has an inward firing flame that fires a full 360 degree's if a cylinder design or all four internal walls if of this design. Due to the burner flame firing in on itself there is a vast increase in burner retention as the opposing flames retain each other thus the maximum capacity of the burner surface media can be increased dramatically and as such reduces the need to have a very low capacity loading of the burner media at low fire thus reducing the temperature of the burner surface. The invention also has a secondary burner that is mounted in the same chamber as the primary yet has its own independent air and gas supply by means of ducting, dampers or separate air fans. This has a result of reducing the minimum firing rate of the burner head chamber as just the secondary burner (if only one secondary) could be firing at minimum rates, all zoned burners will be interlocked by means of electronic or mechanical control systems.

The invention will now be described solely by the way of example and the accompanying drawings in which FIG. 1. Shows a cross sectional view of the primary inward firing burner FIG. 2. Shows a top view of the primary inward firing burner FIG. 3. Shows a secondary burner in a flat version FIG. 4. shows a cross sectional view of both burners Primary and secondary in the main burner chamber.

Figure 5:
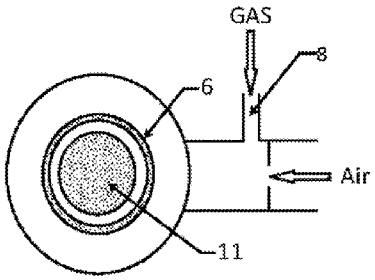

FIG. 5. Shows a top view of both burners primary and secondary.

Figure 2:
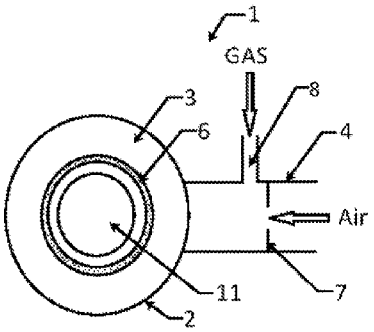

In FIG. 1. This shows a cross sectional view of the primary inward firing burner 1. showing the outer walls of the burner chamber 2. the outlet flange 3. gas air duct 4 distribution plate 5 and burner media 6. The gas air duct can be of various shapes and the distribution plate 5 can also be of several shapes and sizes. This also shows the air duct 4. that supplies the combustion air that passes over the orifice or venturi 7. where gas is then injected 8. and feeds into the primary part of the mixing chamber 9. after which passing over the distribution plate 5. into the secondary mixing chamber 10, In FIG. 2. This shows a top view of the inward firing primary burner 1. showing the outer walls of the burner chamber 2, the outlet flange 3. gas air duct 4. and burner media 6. with the mounting area for the secondary zone burner 11.

Figure 3:
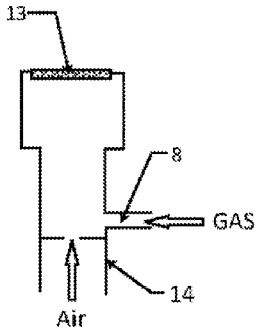

In FIG. 3 this shows a cross sectional view of the secondary burner 12. with the burner media 13 gas air duct 14

Figure 4:
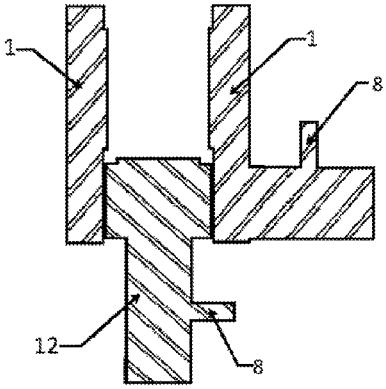

In FIG. 4. this shows a cross sectional view of both the primary burner 1. and secondary burner 12 and the burner chamber outer walls 2.

In FIG. 5. This shows a cross sectional view of multiple burners primary media 6. and secondary 11.

The invention claimed is:

1. An inward firing burner, comprising:

a single chamber within which at least a primary burner and a secondary burner both fire, the primary burner firing inwardly of the single chamber around one or more internal walls of the single chamber, and the secondary burner being mounted at one of a base end or a top end of the single chamber and firing axially into and within the single chamber at the one of the base end or the top end to reduce effects of flame lift.

2. The inward firing burner of claim 1, wherein each of the primary burner and the secondary burner are supplied with gas/air mixes that are independently controlled.

3. The inward firing burner of claim 2, wherein the gas/air mixes supplied to each of the primary burner and the secondary burner are linked to one another by at least one of an electronic means and a mechanical means, the gas/air mixes supplied to each of the primary burner and the secondary burner being modulated so that the primary burner and the secondary burner operate substantially as a single burner head.

4. The inward firing burner of claim 1, each of the primary burner and the secondary burner comprising a burner media material positioned above one surface of which combustion occurs.

5. The inward firing burner of claim 1, the single chamber being cylindrical in cross-section when viewed from at least one of the base end and the top end.

6. The inward firing burner of claim 1, the single chamber having four internal walls.

7. The inward firing burner according to claim 6, the single chamber being square in cross-section when viewed from at least one of the base end and the top end.

8. The inward firing burner of claim 1, the secondary burner being one of domed, cylindrical, conical, and round.

* * * * *